United States Patent [19]

Schaeff

[11] 4,183,711

[45] Jan. 15, 1980

[54] MOBILE POWER SHOVEL

[76] Inventor: Hans Schaeff, P.O. Box 20, 7183 Langenburg, Fed. Rep. of Germany

[21] Appl. No.: 929,905

[22] Filed: Aug. 1, 1978

Related U.S. Application Data

[63] Continuation of Ser. No. 754,528, Dec. 27, 1976, abandoned.

[30] Foreign Application Priority Data

Dec. 24, 1975 [DE] Fed. Rep. of Germany ..... 2558799

[51] Int. Cl.[2] ..... E02F 3/32

[52] U.S. Cl. ..... 414/695; 414/687

[58] Field of Search ..... 214/132, 138 R, 138 C; 37/103; 414/687, 694, 695

[56] References Cited

U.S. PATENT DOCUMENTS

| | | | |
|---|---|---|---|
| 3,167,194 | 1/1965 | Davis et al. | 214/138 C |
| 3,717,269 | 2/1973 | Schaeff | 214/138 R |
| 3,929,239 | 12/1975 | Shumaker | 214/138 R |
| 3,999,670 | 12/1976 | Weyhausen | 214/138 R |

FOREIGN PATENT DOCUMENTS

| | | | |
|---|---|---|---|
| 694115 | 9/1965 | Italy | 214/138 R |

OTHER PUBLICATIONS

Massey-Ferguson's Davis Model 220 Backhoe Pamphlet.

*Primary Examiner*—L. J. Paperner

*Attorney, Agent, or Firm*—Shlesinger, Arkwright, Garvey & Dinsmore

[57] ABSTRACT

A mobile power shovel comprising an upper carriage rotatably mounted on a vehicle chassis and including an attachment holder for an excavator jib, the attachment holder being mounted for pivoting within the envelope circle of the carriage on a slide laterally displaceable along a guide member, the guide member being arranged chordally within the envelope circle and spaced from the slewing axis, so that the slide, the jib, the scoop arm and the digging tool mounted thereon may be positioned within the envelope circle for improved maneuverability of the power shovel.

4 Claims, 4 Drawing Figures

MOBILE POWER SHOVEL

This is a continuation of application Ser. No. 754,528, filed Dec. 27, 1976, abandoned.

The invention relates to a mobile power shovel having an upper carriage rotatable about a vertical axis on a vehicle chassis, the envelope circle of which upper carriage protrudes laterally beyond the vehicle chassis, while on the upper carriage an attachment holder of an excavator jib is pivotable to both sides about a vertical axis out of a position parallel with the longitudinal axis of the upper carriage.

A power shovel has been proposed having an upper carriage pivotable through 360° on the vehicle chassis, while on the upper carriage in turn an attachment holder for a jib is pivotable through at least 180°. Thus it is intended to halt the slewing in different intermediate positions within 180°, in order to be able to excavate correspondingly wide trenches to both sides over this width plus half of the width of the scoop. Since the envelope circle of the upper carriage does not reach out beyond the outer limit surfaces of the vehicle chassis, in excavation along a wall the vehicle chassis must be brought close to the wall. Moreover it is necessary to pivot the attachment holder through nearly 90° out of its normal position, since otherwise the scoop cannot be brought into the vicinity of the wall. In this state unfavorable supporting conditions occur for the forces introduced from the excavating tool through the jib into the attachment holder. Moreover in this state the attachment holder is situated in a retracted position in relation to the front edge of the vehicle, so that the jib can no longer be pivoted steeply downwards and thus it is also impossible to draw a deep trench. Finally when the attachment holder is in the position pivoted through 90°, the view of the excavator driver from the driving position into the trench and over the digging tool is limited and impaired, since the excavator driver must turn away from his operating levers and instruments, and furthermore in this position difficulties arise in the co-ordination of accustomed lever movements with an unaccustomed field or angle of vision.

There has also been proposed a power shovel with an upper carriage pivotable through 360° where with the aid of an attachment holder arranged pivotably on the upper carriage within and in the vicinity of the envelope circle, the object is achieved that the available weight on the upper carriage is optimally exploited in the lateral pivot positions of the jib so that trenches may be drawn directly along a wall, with a compact overall construction and unhindered pivotability of the upper carriage. Certain limitations are imposed in use upon this known power shovel when trenches are to be excavated within narrow limitations on both sides, for example in an open shaft or in a lane limited by walls or buildings, and the excavated material taken up at the front is to be discharged on to a transport vehicle standing behind the excavator.

Therefore the problem of the present invention consists in the further development of a power shovel of the type of construction as described above, to the effect that in working under constricted conditions the excavated material can be pivoted with the digging tool into the envelope circle and then pivoted with the upper carriage to the rear within the envelope circle, and discharged. Taking consideration of the above requirement, the available counter-weight on the upper carriage should be optimally exploitable in the pivot positions of the jib so as to keep the overall construction small and so that if desired a wide trench extending continuously from the one lateral defining wall to the other may be drawn.

In accordance with the invention this problem is solved in that the attachment holder is mounted pivotably within the envelope circle on a slide displaceable along a horizontal guide and the guide is of such length that when the slide is in the end position the jib pivoted transversely to before the guide, with the scoop arm folded against the jib and the digging tool (for example scoop) situated in the transport position are accommodated within the envelope circle of the upper carriage. The horizontal guide is preferably arranged, in plan view, as a chord within the envelope circle of the upper carriage provided by the super-structure and counterweight, and distance of which chord from the axis of rotation of the upper carriage is determined approximately by the dimensions of the swivel ring accommodating the ducts for the hydraulic control conduits.

With the jib, including digging tool, which can be pivoted in front of the horizontal guide, the excavated material taken up in front of the excavator can be brought, within a narrow shaft or under other constricted conditions, into the envelope circle, pivoted with the upper carriage to the rear and then discharged at any desired point, for example on to a lorry waiting there. In such work the slide is situated in one of the two lateral end positions. Although fundamentally from each of these end positions one can draw wide trenches extending over the whole width of the vehicle chassis or over the diameter of the envelope circle, with regard to good conditions of vision from the driving cabin over the digging tool and also with regard to optimum exploitation of the counter-weight, each end position will be utilized only for drawing trenches lying in the region from the one side to the middle of the street, track or shaft, while the trench zones lying in the other half are worked from the opposite end position of the slide. In this way the pivot angle of the jib remains limited to about 45° in relation to the longitudinal axis of the upper carriage, that is to an angle range which is favorable for the exploitation of the counter-weight and the introduction of the digging forces through the jib into the upper carriage. In the case of especially heavy work, in order to achieve optimum stability and symmetrical introduction of digging forces into the vehicle, the slide can be left in the middle of the horizontal guide and of the vehicle chassis, in order then to be shifted laterally for unloading, so that the jib can be pivoted against the guide.

According to a further feature of the invention, the axis of rotation of the upper carriage can be offset on the longitudinal central axis of the vehicle chassis towards one end of the vehicle chassis so far that with the slide standing over the travel line (wheel or caterpiller track), the jib can be pivoted steeply downwards. On the one hand it is desirable to have the distance of the horizontal guide from the slewing axis of the upper carriage as small as possible, so as to make the horizontal guide as long as possible within the envelope circle and thus, taking consideration of the foldability of jib, scoop arm and excavating tool, to render possible the most far-reaching possible digging and unloading equipment, and also in order to be able to excavate as close as possible to a wall or other limitation with the slide situated in the lateral end positions on the guide. This endeavour towards maximum possible length of the horizontal slide guide is opposed by the circumstance that thus the slide guide becomes more remote from the forward end of the vehicle, and the jib is no longer pivotable steeply downwards, and thus deep trenches can no longer be drawn. With the aid of the proposal of offsetting the slewing axis of the upper carriage out of the middle of the vehicle towards one end of the vehicle it is possible to combine and fulfil the abovementioned two requirements.

It can be expedient if the attachment holder is pivotable on the slide by at least 100° to each of the two sides. In this way the pivoting and working range of the jib, in the respective end position, can advantageously be extended in the direction in which the pivoting movement is no longer hindered by the horizontal guide. Furthermore it can be expedient if in the region of the horizontal guide a rack or a chain is arranged on which there rolls a motor-driven pinion secured on the slide, for the transverse displacement of the slide. Thus with relatively simple means a rapid shiftability is achieved, even though for normal purposes the shiftability of the slide known in laterally offsettable attachment excavators is sufficient, which consists in that the digging tool is held fast in the ground and then the slide is moved into the desired position on the horizontal guide with the aid of an extension or contraction movement between jib and scoop arm.

The invention will be described with further details and advantages in the following description of an example of embodiment which is represented diagrammatically in the accompanying drawings, wherein.

Figure 1:
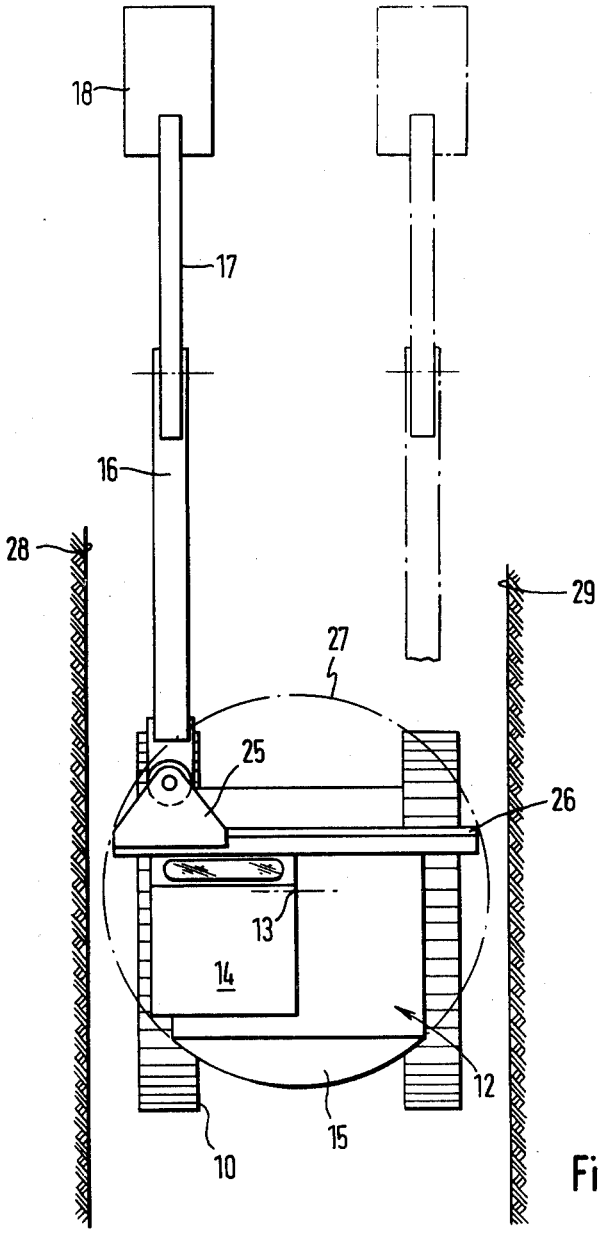
FIG. 1 shows a plan view of a power shovel according to the invention with a track-laying vehicle chassis, the slide with the attachment holder being situated in its left end position on the guide.
Figure 4:
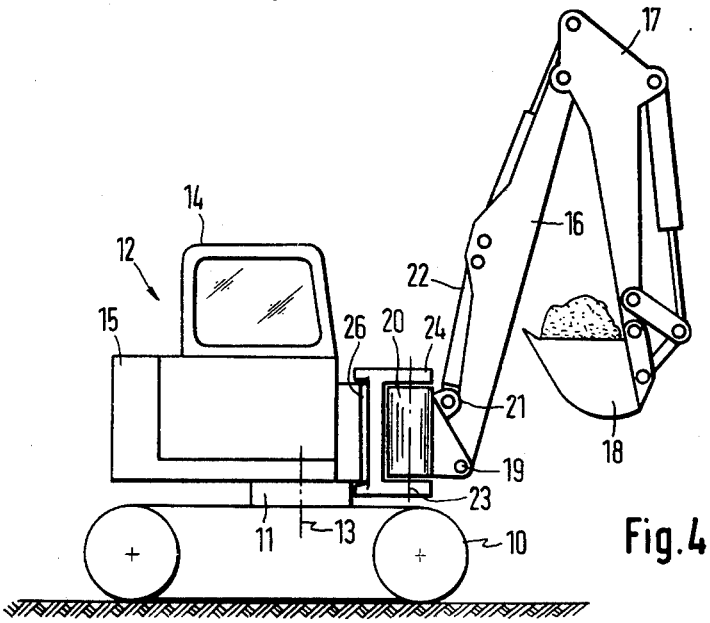
FIG. 4 shows a lateral elevation of the power shovel, related to the illustration of FIG. 1.

In the drawings, according to FIGS. 1 and 4, an upper carriage 12 is mounted for rotation through 360° about a vertical axis 13 by means of a swivel ring 11 on a tracklaying vehicle chassis 10, which can also be replaced by an under carriage running on wheels. Hydraulic control leads (not shown) run through the swivel ring 11 from the operating levers in the driving cabin 14 to the drive motors for the vehicle chassis 10. On the upper carriage 12 a counter-weight 15 is fitted which serves to compensate the forces to be taken up at the opposite end of the upper carriage, which act through the jib 16 and the scoop arm 17 upon the digging tool 18. The jib 16 is mounted at its rear end to carry out vertical pivoting movements about a transverse axis 19.

The horizontal transverse shaft 19 of the jib 16 is situated according to FIG. 4 in the lower region of an attachment holder 20, on the upper end 21 of which a lifting cylinder 22 is supported for the vertical movements of the jib. The attachment holder 20 is preferably pivotable laterally through at least 100° to both sides about a vertical axis 23 out of the middle position as shown in FIG. 4. The pivot axis 23 can be realized by upper and lower, mutally aligned, vertical journals with which the attachment holder 20 is mounted and held in protruding parts 24 of a slide 25. The slide 25 is laterally displaceable on a horizontal guide 26 which is situated according to FIG. 1 within an envelope circle 27 determined by the outer limits of driving cabin 14 and counter-weight 15. The envelope circle 27 protrudes laterally over the vehicle chassis 10 by a certain amount which is determined for example according to FIG. 1 in that between the diagrammatically indicated lateral limits 28, 29 the vehicle must not be brought completely to a limiting wall, so that nevertheless a trench can be drawn with the digging tool 18 in the immediate vicinity of the limit 28.

It can be seen from FIGS. 1 and 4 that the slewing axis 13 of the upper carriage is offset towards the "forward" end of the vehicle chasis 10, so that the jib 16 can be pivoted steeply downwards about its transverse axis 19. FIG. 4 makes it clear that the horizontal guide 26 can be placed as close as possible to the swivel ring 11 and thus as close as possible to the slewing axis 13.

Figure 2:
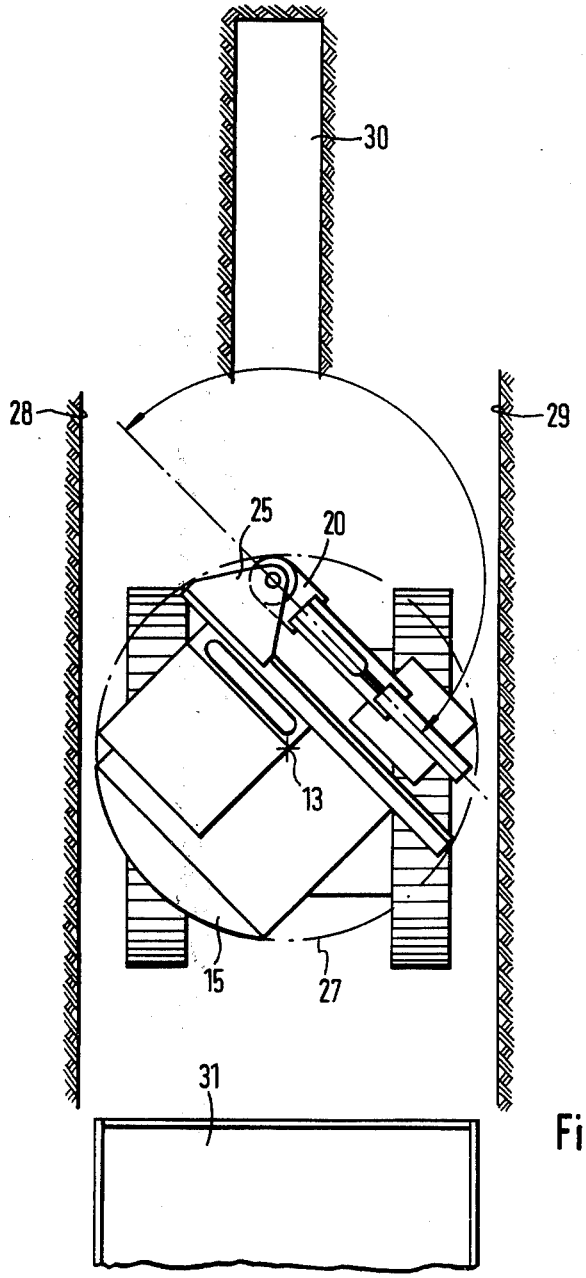
FIG. 2 shows a plan view similar to FIG. 1, with jib and digging tool pivoted into the envelope circle.
Figure 3:
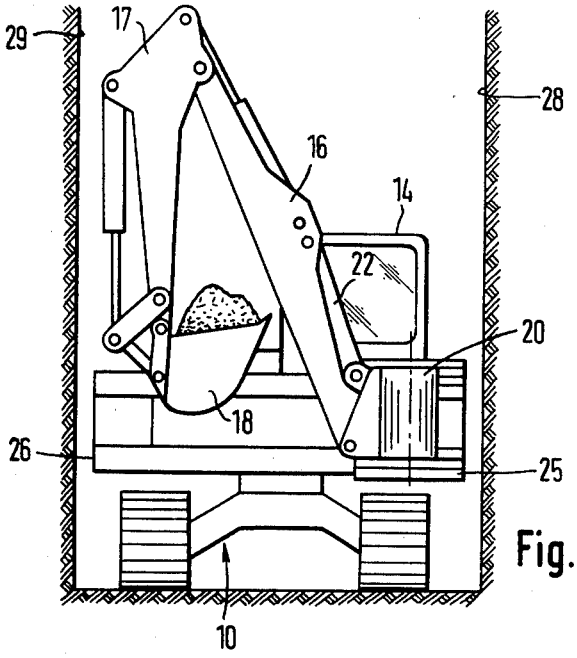
FIG. 3 shows a front view of the poweer shovel with jib with digging tool pivoted laterally in front of the guide.

The overall dimensions of the constructional groups which determine the envelope circle and the jib, scoop arm and excavator scoop are so selected that when the jib 16 is pivoted, in plan view according to FIG. 2, transversely in front of the slide guide 26, the jib with the digging tool remains within the envelope circle 27. FIG. 3 makes it clear that when the jib is pivoted inwards the digging scoop 18 can be held in a position in which the excavated material which it has taken up is held as if in a dish.

FIG. 2 shows a trench 30 commenced between the lateral limits 28, 29 for the execution of which the slide 25 stands in its left end position on the guide 26, so that the jib, when situated in the digging position, extends at an angle of about 45° to the longitudinal axis of the upper carriage 12. With the slide of this position it is possible to excavate all trenches between the lateral limit 28 and the illustrated trench 30, while for work between the trench 30 and the lateral limit 29 the slide is shifted into its opposite end position. With the excavated material which it has taken up the jib with digging tool is pivoted inwards to before the guide 26, whereupon the upper carriage is rotated through about 180° and then by repeated operation of the jib and attached tools the excavated material is unloaded on to a lorry 31 standing ready.

What I claim is:

1. In a mobile power shovel comprising a vehicle chassis, an upper carriage including a counterweight mounted on said chassis for rotation through an arc of 360° about a vertical slewing axis, said carriage further including an attachment holder for an excavator jib pivotable to both sides about a vertical axis out of a position parallel with the longitudinal axis of said carriage, a scoop arm pivotally mounted to said jib and a digging tool operably mounted on said scoop arm, the improvement comprising:

said attachment holder being pivotally mounted within the envelope circle of said carriage on a support having operating positions at lateral ends of a transverse guide, said guide being arranged chordally within said envelope circle and spaced from the slewing axis a distance determined approximately by a swivel ring connection for hydraulic control ducts between said carriage and said chassis, said guide having a length such that with said support in its fixed operating position, when said jib, scoop arm and digging tool are folded against one another and are laterally pivoted by the attachment holder to a position parallel to and in front of said guide, said attachment holder, said jib, said scoop arm and said digging tool are positioned within said envelope circle whereby material taken up by said digging tool in front of said vehicle chassis may be brought into the envelope circle and unloaded from said digging tool outside of the envelope circle at the rear of said vehicle chassis by rotation of said support.

2. A power shovel according to claim 1, characterized in that the slewing axis of the upper carriage is offset on the longitudinal central axis of the vehicle chassis towards one end of the chassis so far that when the slide stands over the track line, the jib can be pivoted steeply downwards.

3. A power shovel according to claim 1, characterized in that the attachment holder is pivotable on the slide by means of a motor drive through about 100° to each of the two sides.

4. A power shovel according to claim 1, characterized in that the guide comprises a rack or chain on which a motor-driven pinion mounted on the slide rolls for the transverse displacement of the slide.

* * * * *